US010208456B2

(12) United States Patent
Ku

(10) Patent No.: US 10,208,456 B2
(45) Date of Patent: Feb. 19, 2019

(54) FLOW CONTROL VALVE FOR CONSTRUCTION EQUIPMENT, HAVING FLOATING FUNCTION

(71) Applicant: VOLVO CONSTRUCTION EQUIPMENT AB, Eskilstuna (SE)

(72) Inventor: Bon-Seuk Ku, Gyeongsangnam-do (KR)

(73) Assignee: VOLVO CONSTRUCTION EQUIPMENT AB (SE)

( * ) Notice: Subject to any disclaimer, the term of this patent is extended or adjusted under 35 U.S.C. 154(b) by 258 days.

(21) Appl. No.: 15/032,926

(22) PCT Filed: Oct. 31, 2013

(86) PCT No.: PCT/KR2013/009785
§ 371 (c)(1),
(2) Date: Apr. 28, 2016

(87) PCT Pub. No.: WO2015/064785
PCT Pub. Date: May 7, 2015

(65) Prior Publication Data

US 2016/0251831 A1 Sep. 1, 2016

(51) Int. Cl.

| | |
|---|---|
| ***F15B 13/02*** | (2006.01) |
| ***E02F 9/22*** | (2006.01) |
| ***F15B 11/15*** | (2006.01) |
| ***F15B 13/04*** | (2006.01) |

(Continued)

(52) U.S. Cl.
CPC ..... *E02F 9/2203* (2013.01); *E02F 9/2267* (2013.01); *E02F 9/2296* (2013.01);
(Continued)

(58) Field of Classification Search
CPC ..... F15B 13/021; F15B 2211/3058
(Continued)

(56) References Cited

U.S. PATENT DOCUMENTS

2011/0220231 A1 9/2011 Sohn

FOREIGN PATENT DOCUMENTS

CN 101253335 A 8/2008
CN 101498324 A 8/2009
(Continued)

OTHER PUBLICATIONS

International Search Report for PCT/KR2013/009785 dated Jul. 29, 2014.

*Primary Examiner* — Thomas E Lazo
*Assistant Examiner* — Daniel Collins
(74) *Attorney, Agent, or Firm* — Lerner, David, Littenberg, Krumholz & Mentlik, LLP

(57) ABSTRACT

Disclosed is a hydraulic circuit for construction equipment, having a floating function for ground leveling work, which can be implemented by a main control valve. According to the present invention, provided is a flow control valve for construction equipment, having a floating function, comprising: a valve body having, formed therein, a supply path in communication with a pump path to which hydraulic oil is supplied from a hydraulic pump, and first and second actuator paths connected to a hydraulic cylinder driven by the hydraulic oil from the hydraulic pump; a spool switchably built into the valve body for, when switched, communicating the supply path into the first and second actuator paths so as to supply, to the hydraulic cylinder, the hydraulic oil from the hydraulic pump via the supply path and the first actuator path and return, to a tank path, the hydraulic oil discharged from the hydraulic cylinder via the second actuator path; a recycling path for supplying, to a small chamber of the hydraulic cylinder, a portion of the hydraulic oil returned from a large chamber of the hydraulic cylinder to the tank path and recycling the same; and a valve for floating conversion, installed at a predetermined position of the
(Continued)

recycling path, wherein, in case of conversion to a floating state by application of pilot pressure to the valve for floating conversion, the large chamber and the small chamber of the hydraulic cylinder are communicated, and a path for supplying the hydraulic oil to the small chamber of the hydraulic cylinder and the recycling path are communicated so as to enable a bi-directional flow of the hydraulic oil.

3 Claims, 4 Drawing Sheets

(51) Int. Cl.
*F15B 13/042* (2006.01)
*E02F 3/32* (2006.01)

(52) U.S. Cl.
CPC ..... *F15B 11/15* (2013.01); *F15B 13/021* (2013.01); *F15B 13/0401* (2013.01); *F15B 13/0426* (2013.01); *E02F 3/32* (2013.01); *E02F 9/2285* (2013.01); *F15B 2211/205* (2013.01); *F15B 2211/255* (2013.01); *F15B 2211/3058* (2013.01)

(58) Field of Classification Search
USPC ..... 91/436, 437
See application file for complete search history.

(56) References Cited

FOREIGN PATENT DOCUMENTS

| | | | |
|---|---|---|---|
| CN | 101922162 | A | 12/2010 |
| DE | 102011111416 | A1 | 2/2013 |
| EP | 0389136 | A1 | 9/1990 |
| JP | H09287176 | A | 11/1997 |
| JP | H10-96402 | A | 4/1998 |
| KR | 20100032471 | A | 3/2010 |
| KR | 20100044941 | A | 5/2010 |
| KR | 20100056087 | A | 5/2010 |

[Fig. 1] PRIOR ART
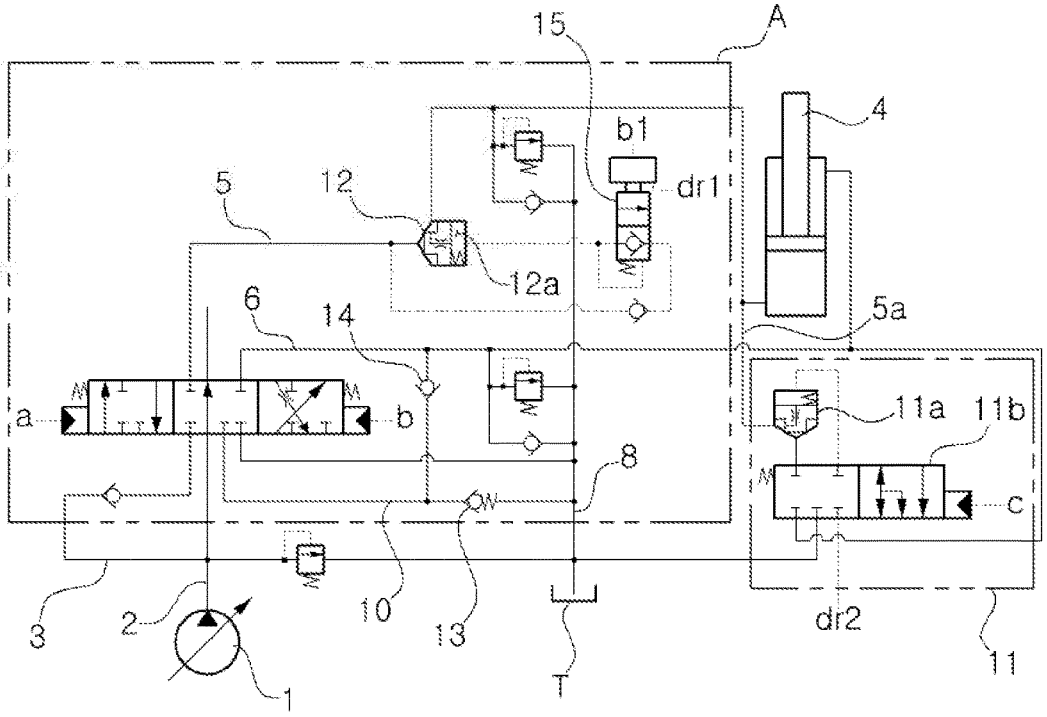
[Fig. 2] PRIOR ART
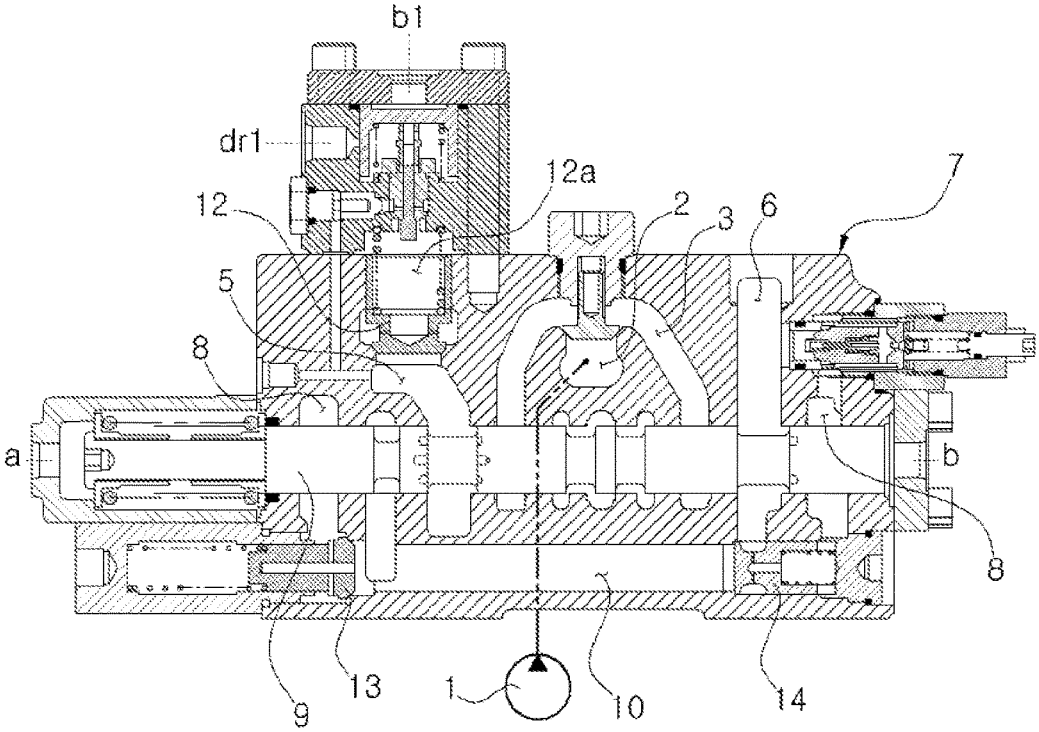

[Fig. 3]
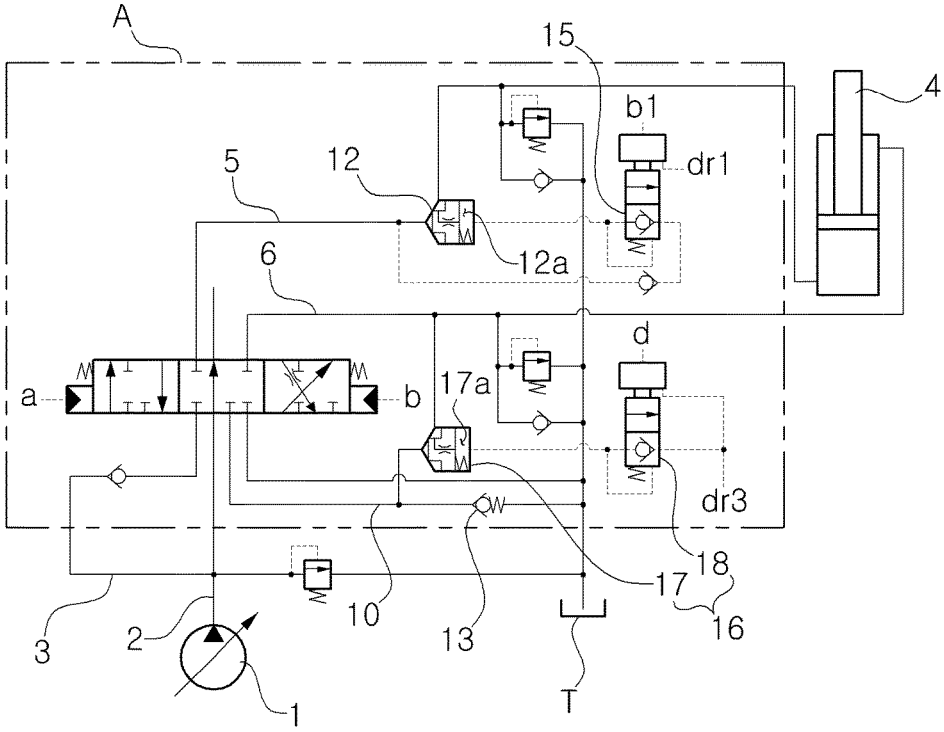
[Fig. 4]
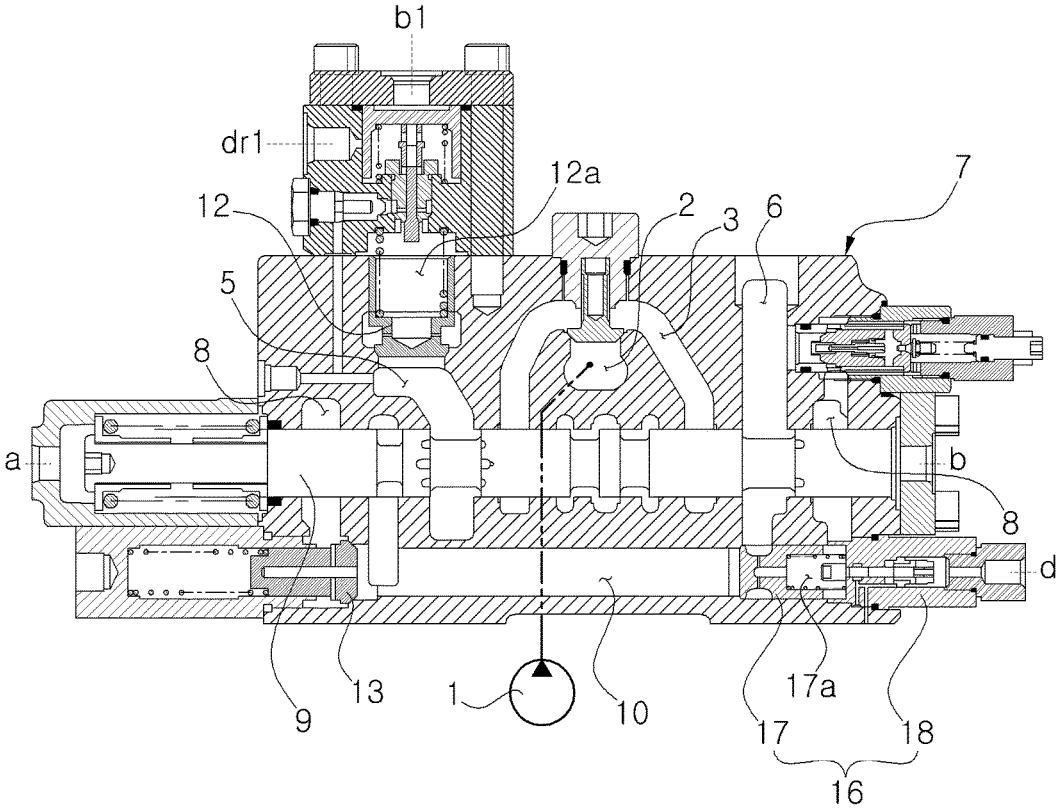

[Fig. 5]
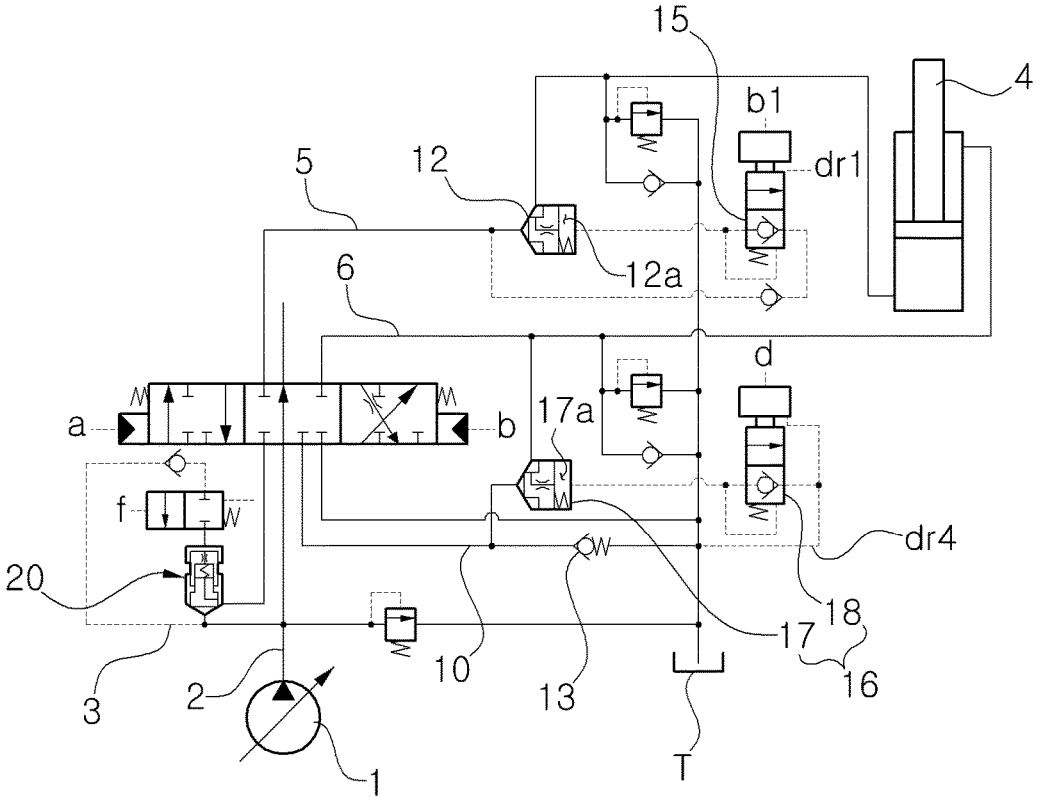
[Fig. 6]
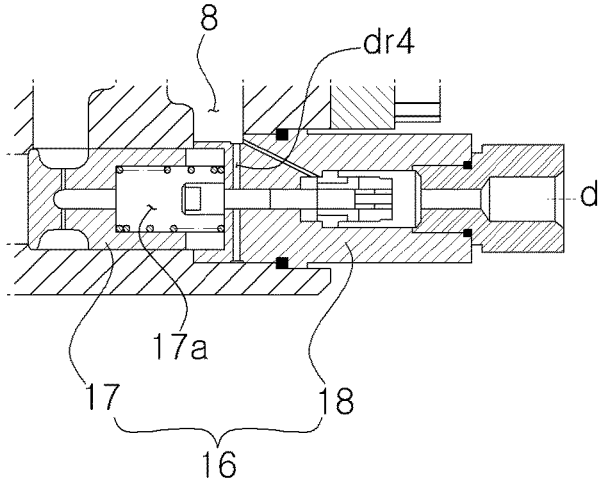

[Fig. 7]
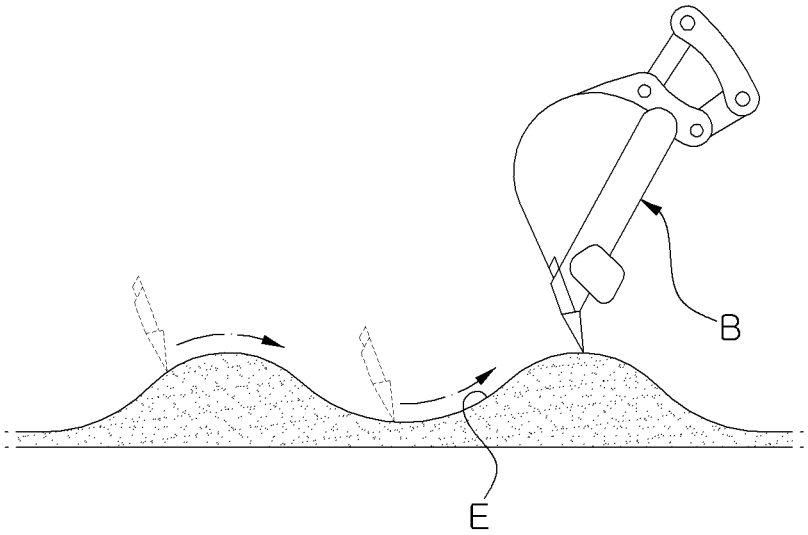

FLOW CONTROL VALVE FOR CONSTRUCTION EQUIPMENT, HAVING FLOATING FUNCTION

CROSS-REFERENCE TO RELATED APPLICATION

This application is a national phase entry under 35 U.S.C. § 371 of International Application No. PCT/KR2013/009785, filed Oct. 31, 2013, which is incorporated herein by reference.

TECHNICAL FIELD

The present invention relates to a flow control valve for construction equipment, and more particularly, to a flow control valve for construction equipment, in which a floating function for ground leveling work can be realized using a main control valve (MCV).

BACKGROUND ART

FIG. 1 and FIG. 2 are a hydraulic circuit diagram and a cross sectional view of a flow control valve for construction equipment having a floating function of the related art.

As illustrated in FIG. 1 and FIG. 2, the flow control valve includes: a valve body 7 defining a supply passage communicating with a pump passage 2 through which working fluid is supplied from a hydraulic pump 1 and first and second actuator passages 5 and 6 connected to a hydraulic cylinder 4 actuated by working fluid supplied from the hydraulic pump 1;

a spool 9 switchably disposed within the valve body 7, wherein the spool 9 is switched to allow the supply passage 3 to communicate with the first or second actuator passage 5 or 6, such that an amount of working fluid from the hydraulic pump 1 is supplied to the hydraulic cylinder 4 through the supply passage 3 and the first actuator passage 5, and an amount of working fluid discharged from the hydraulic cylinder 4 returns to a tank passage 8 through the second actuator passage 6;

a regeneration passage 10 through which a portion of working fluid returning to the tank passage 8 from a large chamber of the hydraulic cylinder 4 is supplied to a small chamber of the hydraulic cylinder 4 such that the portion of working fluid is regenerated;

a floating switching valve 11 including a logic valve 11*a* configured to open and close a passage 5*a* branched from the first actuator passage 5, wherein the floating switching valve 11 is switched in response to a pilot pressure c applied thereto to drain working fluid from a back pressure chamber of the logic valve 11*a* through a control valve 11*b* and a drain line dr2, thereby opening the passage 5*a*, such that, when a floating function of causing the large chamber and the small chamber of the hydraulic cylinder 4 to communicate with each other is selected, the large chamber and the small chamber of the hydraulic cylinder 4 communicate with each other, and a portion of working fluid from the large chamber and the small chamber communicating with each other is connected to a working fluid tank T; and a logic valve 12 openably and closably disposed in the first actuator passage 5 to prevent a boom from moving downwardly due to contraction of the hydraulic cylinder 4 caused by an oil leakage.

A) A case of lifting the boom by actuating the hydraulic cylinder 4 will be described.

When the spool 9 is switched to the right on the drawing in response to a pilot pressure a being applied thereto, an amount of working fluid from the hydraulic pump 1 is supplied to the large chamber of the hydraulic cylinder 4 through sequentially, the pump passage 2, the supply passage 3, the spool 9, the first actuator passage 5, and the logic valve 12. At this time, an amount of working fluid discharged from the small chamber of the hydraulic cylinder 4 returns to the working fluid tank T through sequentially, the second working fluid passage 6, the spool 9, and the tank passage 8.

Thus, the stretching of the hydraulic cylinder 4 (a so called boom cylinder) can lift the boom (boom up).

B) A case of lowering the boom by actuating the hydraulic cylinder 4 will be described.

When the spool 9 is switched to the left on the drawing in response to a pilot pressure b applied thereto, an amount of working fluid from the hydraulic pump 1 is supplied to the small chamber of the hydraulic cylinder 4 through sequentially, the pump passage 2, the supply passage 3, the spool 9, and the second actuator passage 6.

At this time, a pilot pressure b1 is applied to the control valve 15, such that an amount of working fluid from the back pressure chamber 12*a* of the logic valve 12 communicates with the first actuator passage 5 through the control valve 15 to open the logic valve 12. Then, an amount of working fluid discharged from the large chamber of the hydraulic cylinder 4 returns to the working fluid tank T through sequentially, the logic valve 12, the first actuator passage 5, the spool 9, the regeneration passage 10, a booster valve 13, and the tank passage 8.

When the pressure of working fluid within the regeneration passage 10 is higher than the pressure within the second actuator passage 6, a portion of working fluid in the regeneration passage 10 may merge with working fluid in the second actuator passage 6 through a check valve 14 disposed in the regeneration passage 10, thereby being supplied to the small chamber of the hydraulic cylinder 4.

Consequently, the contraction of the hydraulic cylinder 4 can lower the boom (boom down).

C) A case of performing a floating function will be described.

When a pilot pressure c is applied to the control valve 11*b* of the floating switching valve 11, the control valve 11*b* is switched to the left on the drawing, an amount of working fluid drains from the back pressure chamber of the logic valve 11*a* through the control valve 11*b* and the drain line dr2. That is, when the control valve 11*b* is switched, the large chamber and the small chamber of the hydraulic cylinder 4 communicate with each other, and a portion of working fluid within the communicating large and small chambers flows to the working fluid tank T.

Since separately from a main control valve (MCV) is provided a floating switching valve 11, which provides a floating function allowing a bucket B to move along an irregular surface E to perform ground leveling work, as illustrated in FIG. 7, the number of parts increases, thereby increasing the manufacturing cost. In addition, since the floating switching valve 11 is additionally provided, the layout of equipment becomes complicated, and cost for the floating switching valve 11 is additionally caused, which are problematic.

DISCLOSURE

Technical Problem

Accordingly, the present invention has been made keeping in mind the above problems, and an object of the present invention is to provide a flow control valve for construction equipment, in which a floating function is realized using a main control valve (MCV) to simplify the layout of equipment and reduce the number of parts, thereby reducing the manufacturing cost.

Technical Solution

In order to achieve the above object, according to an embodiment of the present invention, a flow control valve for construction equipment having a floating function, includes:

a valve body defining a supply passage communicating with a pump passage through which working fluid is supplied from a hydraulic pump and first and second actuator passages connected to a hydraulic cylinder actuated by working fluid supplied from the hydraulic pump;

a spool switchably disposed within the valve body, wherein the spool is switched to allow the supply passage to communicate with the first or second actuator passage, such that working fluid from the hydraulic pump is supplied to the hydraulic cylinder through the supply passage and the first actuator passage, and working fluid discharged from the hydraulic cylinder returns to a tank passage through the second actuator passage;

a regeneration passage through which a portion of working fluid returning to the tank passage from a large chamber of the hydraulic cylinder is supplied to a small chamber of the hydraulic cylinder such that the portion of working fluid is regenerated;

a floating switching valve disposed in the regeneration passage, wherein the floating switching valve is switched to a floating position in response to a pilot pressure applied thereto, thereby causing the large chamber and the small chamber of the hydraulic cylinder to communicate with each other and causing the second actuator passage, through which working fluid is supplied to the small chamber of the hydraulic cylinder, and the regeneration passage to communicate with each other, such that an amount of working fluid is allowed to flow in both directions; and a booster valve disposed in a passage between the regeneration passage and the tank passage, wherein the booster valve allows a portion of working fluid in the large chamber and the small chamber of the hydraulic cylinder to flow to the tank passage when the floating switching valve is switched to the floating position.

The floating switching valve may include:

a logic valve opening and closing the regeneration passage; and a control valve disposed in a passage between a back pressure chamber of the logic valve and a working fluid tank, wherein, when the control valve is switched in response to the pilot pressure applied thereto to switch the floating switching valve to the floating position, working fluid drains from the back pressure chamber of the logic valve, thereby allowing an amount of working fluid to flow to the regeneration passage from the second actuator passage through which working fluid is supplied to the small chamber of the hydraulic cylinder.

A drain line, through which the working fluid drains from the back pressure chamber of the logic valve, may be connected to a port outside of the valve body.

A drain line, through which the working fluid drains from the back pressure chamber of the logic valve, may be connected to the tank passage within the valve body.

The flow control valve may further include a priority selection valve disposed upstream in the supply passage, wherein, when the floating switching valve is switched to the floating position, and the priority selection valve is switched in response to a pilot pressure applied thereto to perform a combined operation by actuating a hydraulic actuator other than the hydraulic cylinder, the priority selection valve supplies an amount of working fluid from the hydraulic pump to the other hydraulic actuator.

The floating switching valve may be disposed inside or outside of the valve body.

Advantageous Effects

According to the present invention configured as described above, a floating function is realized using the MCV. Since a separate floating switching valve is unnecessary, it is possible to simplify the layout of equipment and reduce the number of parts, thereby reducing the manufacturing cost.

DESCRIPTION OF DRAWINGS

FIG. 1 is a hydraulic circuit diagram illustrating a related-art flow control valve for construction equipment having a floating function;

FIG. 2 is a cross sectional view illustrating the related-art flow control valve for construction equipment having a floating function illustrated in FIG. 1;

FIG. 3 is a hydraulic circuit diagram illustrating a flow control valve for construction equipment having a floating function according to a first embodiment of the present invention;

FIG. 4 is a cross sectional view illustrating the flow control valve for construction equipment having the floating function illustrated in FIG. 3;

FIG. 5 is a hydraulic circuit diagram illustrating a flow control valve for construction equipment having a floating function according to a second embodiment of the present invention;

FIG. 6 is a view illustrating a key part of a drain line illustrated in FIG. 5; and FIG. 7 is a view illustrating a floating function according to some embodiments of the present invention.

DESCRIPTION OF THE REFERENCE NUMERALS IN THE DRAWINGS

1: hydraulic pump
2: pump passage
3: supply passage
4: hydraulic cylinder
5: first actuator passage
6: second actuator passage
7: valve body
8: tank passage
9: spool
10: regeneration passage
12, 17: logic valve
13: booster valve
16: floating switching valve
18: control valve

BEST MODE

Hereinafter, some exemplary embodiments of a hydraulic circuit for construction equipment having a floating function according to the present invention will be described in detail with reference to the accompanying drawings.

FIG. 3 is a hydraulic circuit diagram illustrating a flow control valve for construction equipment having a floating function according to a first embodiment of the present invention. FIG. 4 is a cross sectional view illustrating the flow control valve for construction equipment having the floating function, illustrated in FIG. 3. FIG. 5 is a hydraulic circuit diagram illustrating another flow control valve for construction equipment having a floating function according to a second embodiment of the present invention. FIG. 6 is a view illustrating a key part of a drain line illustrated in FIG. 5. FIG. 7 is a view illustrating a floating function according to some embodiments of the present invention.

Referring to FIG. 3 and FIG. 4, the flow control valve for construction equipment having the floating function according to the first embodiment of the present invention includes:

a valve body 7 defining a supply passage 3 communicating with a pump passage 2 through which working fluid is supplied from a hydraulic pump 1 and first and second actuator passages 5 and 6 connected to a hydraulic cylinder 4 actuated by working fluid supplied from the hydraulic pump 1;

a spool 9 switchably disposed within the valve body 7, wherein the spool 9 is switched to allow the supply passage 3 to communicate with the first or second actuator passage 5 or 6, such that working fluid from the hydraulic pump 1 is supplied to the hydraulic cylinder 4 through the supply passage 3 and the first actuator passage 5, and working fluid discharged from the hydraulic cylinder 4 returns to a tank passage 8 through the second actuator passage 6;

a regeneration passage 10 through which a portion of working fluid returning to the tank passage 8 from a large chamber of the hydraulic cylinder 4 is supplied to a small chamber of the hydraulic cylinder 4 such that the portion of working fluid is regenerated;

a floating switching valve 16 disposed at a location in the regeneration passage 10, wherein the floating switching valve 16 is switched to a floating position in response to a pilot pressure d applied thereto, thereby causing the large chamber and the small chamber of the hydraulic cylinder 4 to communicate with each other and causing the second actuator passage, through which working fluid is supplied to the small chamber of the hydraulic cylinder 4, and the regeneration passage 10 to communicate with each other such that an amount of working fluid can flow in both directions; and a booster valve 13 disposed in a passage between the regeneration passage 10 and the tank passage 8, wherein the booster valve 13 allows a portion of working fluid in the large chamber and the small chamber of the hydraulic cylinder 4 to flow to the tank passage 8 when the floating switching valve 16 is switched to the floating position.

The floating switching valve 16 includes:

a logic valve 17 opening and closing the regeneration passage 10; and a control valve 18 disposed in a passage between a back pressure chamber 17*a* of the logic valve 17 and a working fluid tank T. When the control valve 18 is switched in response to the pilot pressure d applied thereto in order to switch the floating switching valve 16 to the floating position, working fluid may drain from the back pressure chamber 17*a* of the logic valve 17 through the control valve 18 and a drain line dr3, thereby allowing an amount of working fluid to flow to the regeneration passage 10 from the second actuator passage 6 through which working fluid is supplied to the small chamber of the hydraulic cylinder 4.

A drain line dr3, through which the working fluid drains from the back pressure chamber 17*a* of the logic valve 17, may be connected to a port outside of the valve body 7.

A drain line dr3, through which the working fluid drains from the back pressure chamber 17*a* of the logic valve 17, may be connected to the tank passage 8 within the valve body 7.

A priority selection valve 20 may be disposed upstream in the supply passage 3. In the case in which the floating switching valve 16 is switched to the floating position, when the priority selection valve 20 is switched in response to a pilot pressure f applied thereto to perform a combined operation by actuating a hydraulic actuator (not shown) other than the hydraulic cylinder 4, the priority selection valve 20 supplies an amount of working fluid from the hydraulic pump 1 to the other hydraulic actuator.

The floating switching valve 16 may be disposed inside or outside of the valve body 7.

As described above, the configuration of lifting a boom by stretching the hydraulic cylinder 4 using an amount of working fluid supplied from the hydraulic pump 1 due to the switching of the spool 9 in response to a pilot pressure a applied thereto is the same as in FIG. 2, and a detailed description thereof will be omitted.

Hereinafter, a case of lowering the boom by actuating the hydraulic cylinder 4 will be described.

When the spool 9 is switched to the left on the drawing in response to a pilot pressure b applied thereto, an amount of working fluid from the hydraulic pump 1 is supplied to the small chamber of the hydraulic cylinder 4 through sequentially, the pump passage 2, the supply passage 3, the spool 9, and the second actuator passage 6.

Here, when a pilot pressure b1 is applied to the control valve 15, an amount of working fluid discharged from the back pressure chamber 12*a* of the logic valve 12 communicates with the first actuator passage 5 through the control valve 15, thereby opening the logic valve 12. Then, an amount of working fluid discharged from the large chamber of the hydraulic cylinder 4 returns to the working fluid tank T through sequentially, the logic valve 12, the first actuator passage 5, the spool 9, the regeneration passage 10, the booster valve 13, and the tank passage 8.

In this case, when the pressure of working fluid within the regeneration passage 10 is higher than the pressure within the second actuator passage 6, a portion of working fluid in the regeneration passage 10 may merge with working fluid in the second actuator passage 6 through the logic valve 17 disposed in the regeneration passage 10, thereby being supplied to the small chamber of the hydraulic cylinder 4.

Consequently, the contraction of the hydraulic cylinder 4 can lower the boom (boom down).

Hereinafter, a case of performing the floating function for ground leveling work will be described.

Specifically, in the position in which the boom is lowered by contracting the hydraulic cylinder 4 to perform ground leveling work, when a pilot pressure d is applied to the control valve 18 of the floating switching valve 16, the spool of the control valve 18 is switched downwardly on the drawing of FIG. 3, such that an amount of working fluid drains from the back pressure chamber 17*a* of the logic valve 17 through the control valve 18 and the drain line dr3.

Consequently, the passage 19 through which the second actuator passage 6 communicates with the regeneration passage 10 is opened, thereby allowing working fluid to flow from the second actuator passage 6 to the regeneration passage 10. That is, the large chamber and the small chamber of the hydraulic cylinder 4 communicate with each other, and a portion of working fluid from the large chamber and the small chamber of the hydraulic cylinder 4 communicating with each other is caused to flow to the working fluid tank T through sequentially, the booster valve 13 and the tank passage 8.

As described above, the floating switching valve 16 for ground leveling work is provided and realized within the valve body 7 of a main control valve (MCV) A, thereby removing the problem in that the separate floating switching valve 11 (including the logic valve 11*a* and the control valve 15) is attached to the MCV A as in FIG. 1.

In addition, as illustrated in FIG. 5, a drain line dr4 draining working fluid in the back pressure chamber 17*a* of the logic valve 17 may be connected to the tank passage 8 in the valve body 7. It is thereby possible to perform ground leveling work by allowing the large chamber and the small chamber of the hydraulic cylinder 4 to communicate with each other by switching the control valve 18 disposed in the passage 19, through which the second actuator passage 6 communicates with the regeneration passage 10, to an open position.

Furthermore, as illustrated in FIG. 5, in the position in which the floating function is selected, when a combined operation may be performed by driving a hydraulic actuator (not shown) other than the hydraulic cylinder 4 (a so-called boom cylinder), an amount of working fluid from the hydraulic pump 1 may be supplied to the other hydraulic actuator with priority to the hydraulic cylinder 4.

That is, as the pilot pressure f applied to the control valve of the priority selection valve 20 disposed upstream in the supply passage switches the spool to the right on the drawing, an amount of working fluid supplied from the hydraulic pump 1 may apply pressure to the priority selection valve 20, thereby closing the supply passage 3. It is therefore possible to supply an amount of working fluid from the hydraulic pump 1 to the other hydraulic actuator with priority to the hydraulic cylinder 4.

Although the specific exemplary embodiments of the present disclosure have been presented in the foregoing descriptions, many modifications and variations are obviously possible for a person having ordinary skill in the art without departing from the principle and scope of the present invention defined by the appended claims.

INDUSTRIAL APPLICABILITY

According to the present invention having the foregoing features, it is possible to realize a floating function using a MCV to simplify the layout of equipment and reduce the number of parts, thereby reducing the manufacturing cost.

The invention claimed is:

1. A flow control valve for construction equipment having a floating function, comprising:

a valve body defining a supply passage communicating with a pump passage through which working fluid is supplied from a hydraulic pump and first and second actuator passages connected to a hydraulic cylinder actuated by working fluid supplied from the hydraulic pump;

a spool switchably disposed within the valve body, wherein the spool is switched to allow the supply passage to communicate with the first or second actuator passage, such that working fluid from the hydraulic pump is supplied to the hydraulic cylinder through the supply passage and the first actuator passage, and working fluid discharged from the hydraulic cylinder returns to a tank passage through the second actuator passage;

a regeneration passage through which a portion of working fluid returning to the tank passage from a large chamber of the hydraulic cylinder is supplied to a small chamber of the hydraulic cylinder such that the portion of working fluid is regenerated; and a floating switching valve disposed in the regeneration passage, wherein the floating switching valve is switched to a floating position in response to a pilot pressure applied thereto, thereby causing the large chamber and the small chamber of the hydraulic cylinder to communicate with each other, and causing the second actuator passage, through which working fluid is supplied to the small chamber of the hydraulic cylinder, and the regeneration passage to communicate with each other, such that an amount of working fluid is allowed to flow in both directions;

wherein the floating switching valve comprises:

a logic valve opening and closing the regeneration passage; and a control valve disposed in a passage between a back pressure chamber of the logic valve and a working fluid tank, wherein, when the control valve is switched in response to the pilot pressure applied thereto to switch the floating switching valve to the floating position, working fluid drains from the back pressure chamber of the logic valve, thereby allowing an amount of working fluid to flow to the regeneration passage from the second actuator passage through which working fluid is supplied to the small chamber of the hydraulic cylinder; and wherein a drain line, through which the working fluid drains from the back pressure chamber of the logic valve, is connected to the tank passage within the valve body.

2. The flow control valve according to claim 1, wherein a drain line, through which the working fluid drains from the back pressure chamber of the logic valve, is connected to a port outside of the valve body.

3. The flow control valve according to claim 1, wherein the floating switching valve is disposed inside or outside of the valve body.

* * * * *